United States Patent [19]

Sun

[11] 4,235,710

[45] Nov. 25, 1980

[54] METHODS AND APPARATUS FOR SEPARATING PARTICLES USING A MAGNETIC BARRIER

[75] Inventor: Jack J. Sun, Trenton, N.J.

[73] Assignee: S. G. Frantz Company, Inc., Trenton, N.J.

[21] Appl. No.: 921,232

[22] Filed: Jul. 3, 1978

Related U.S. Application Data

[63] Continuation of Ser. No. 668,080, Mar. 18, 1976, abandoned.

[51] Int. Cl.[3] ..... B03C 1/02

[52] U.S. Cl. ..... 209/213; 209/223 R; 209/232; 210/222

[58] Field of Search ..... 209/212, 213, 214, 223 R, 209/232; 210/222

[56] References Cited

U.S. PATENT DOCUMENTS

| | | | |
|---|---|---|---|
| 2,056,426 | 10/1936 | Frantz | 209/214 X |
| 2,065,460 | 12/1936 | Johnson | 209/214 |
| 2,088,364 | 7/1937 | Ellis et al. | 209/214 |
| 2,976,995 | 3/1961 | Forrer | 209/223 R |
| 3,318,447 | 5/1967 | Ellingboe et al. | 209/213 |
| 3,382,977 | 5/1968 | Fraas | 209/214 |
| 3,595,386 | 7/1971 | Nradel | 209/232 X |
| 3,608,718 | 9/1971 | Aubrey, Jr. et al. | 209/214 |
| 3,877,578 | 4/1975 | Morey | 209/215 |

OTHER PUBLICATIONS

Trade Brochure Describing the Frantz Isodynamic Magnetic Separator, 1977.

Frantz, "Separation by Magnetic Methods", Chemical & Metallurgical Engineering, vol. 45, No. 5, 1938 May.

Gaudin et al., "Magnetic Separation of Sulphide Minerals", Technical Publication No. 1549, Amer. Instit. of Mining & Metallurgical Eng., Jan. 1943.

"Instructions for Installing and Operating the Frantz Isodynamic Separator Model L-1 Serial No. ", Mar. 1963.

"Notes on Operation of Frantz Isodynamic Separator", H. H. Hess, Princeton University, Nov. 1966.

*Primary Examiner*—Arnold Turk

*Attorney, Agent, or Firm*—Brumbaugh, Graves, Donohue & Raymond

[57] ABSTRACT

A flowable mixture of particles is separated in accordance with the magnetic susceptibilities of the particles by feeding the mixture into a magnetic field in such a manner that the mixture is urged by a non-magnetic force, e.g., gravity, towards the locus at which the magnetic energy gradient $H\partial H/\partial X$ of the field is at a maximum. The magnetic energy gradient defines a magnetic barrier along the locus of its maximum magnitude which exerts a magnetic force on the particles in opposition to the non-magnetic feeding force. Particles having a magnetic susceptibility lower than that value at which the force exerted by the magnetic barrier balances the non-magnetic feeding force pass through the barrier, whereas particles of greater magnetic susceptibility are prevented from crossing from one side of the barrier to the other side and may thereafter be recovered separately from the less susceptible particles. Continuous separations may be carried out by giving the mixture a velocity component lengthwise of the barrier such that particles deflected by the barrier will move therealong to a collection point. The magnitude of the maximum magnetic energy gradient may be varied along the length of the barrier or plural barriers of different strengths may be provided in succession to provide for progressive separation of the mixture into fractions of different magnetic susceptibilities.

42 Claims, 23 Drawing Figures

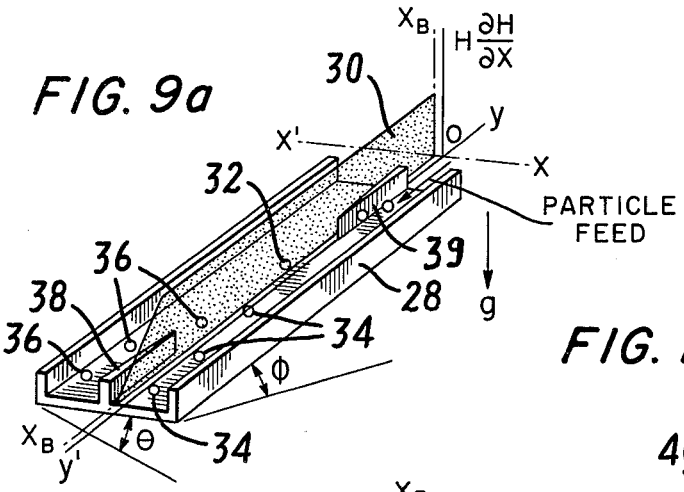
FIG. 9a
$X_B$
$H\frac{\partial H}{\partial X}$
30
X'
o
y
X
32
PARTICLE FEED
36
39
38
28
g
36
34
ϕ
$X_B$
θ
34
y'

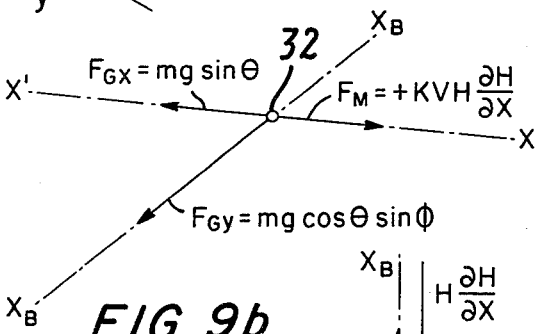
32
$X_B$
X'
$F_{GX} = mg \sin\theta$
$F_M = +KVH\frac{\partial H}{\partial X}$
X
$F_{Gy} = mg \cos\theta \sin\phi$
$X_B$
FIG. 9b

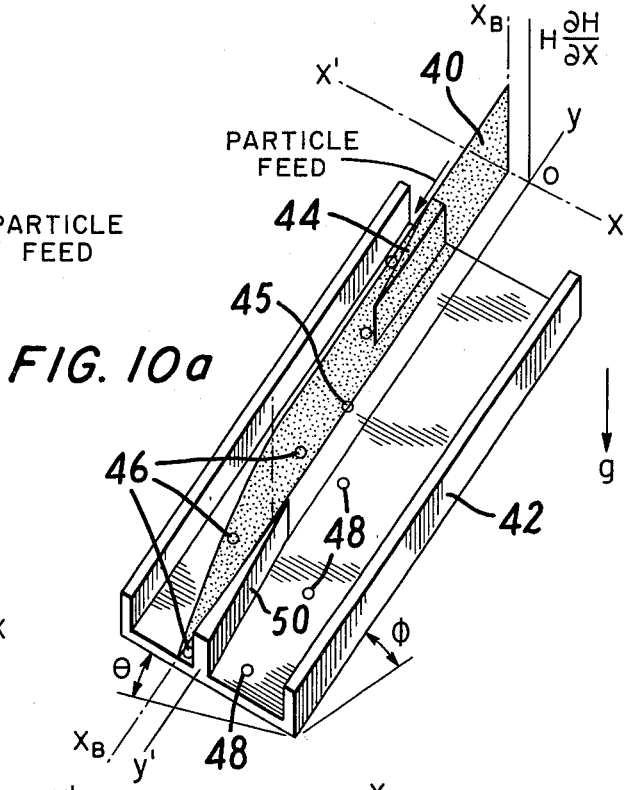
$X_B$
$H\frac{\partial H}{\partial X}$
X'
40
y
PARTICLE FEED
o
X
44
45
FIG. 10a
g
46
48
42
50
ϕ
θ
$X_B$
y'
48

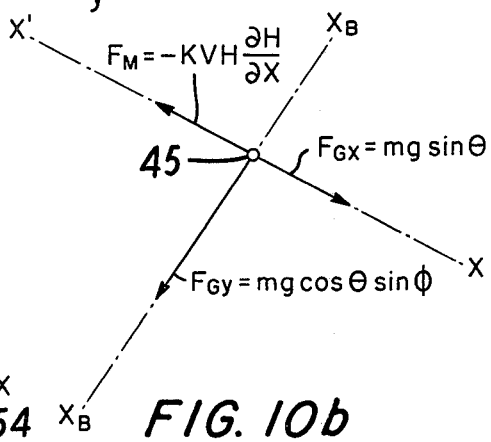
X'
$X_B$
$F_M = -KVH\frac{\partial H}{\partial X}$
45
$F_{GX} = mg \sin\theta$
X
$F_{Gy} = mg \cos\theta \sin\phi$
$X_B$
FIG. 10b

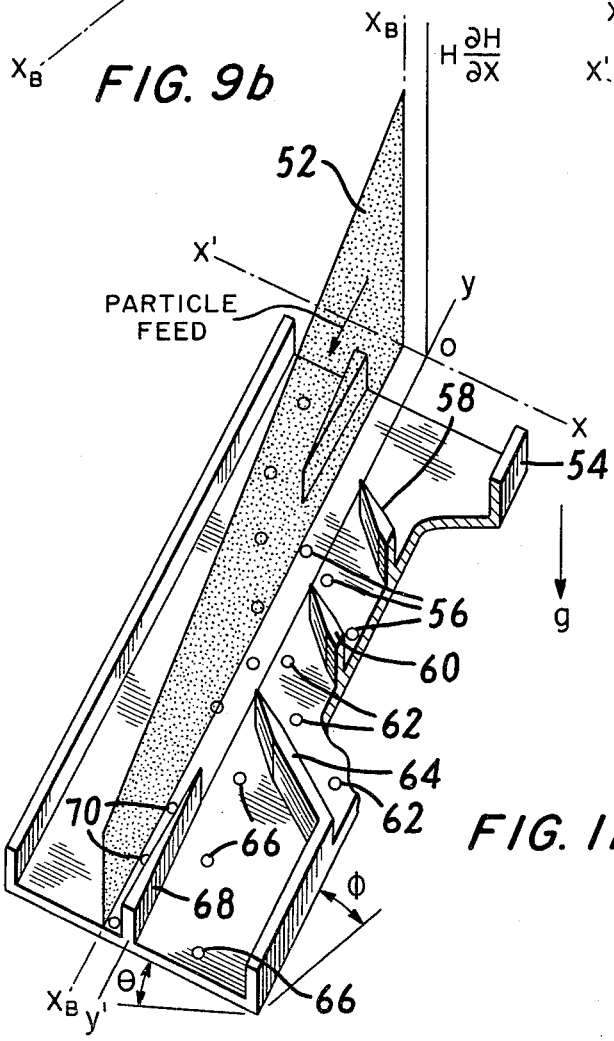
$X_B$
$H\frac{\partial H}{\partial X}$
52
X'
y
PARTICLE FEED
o
58
X
54
g
56
60
62
64
70
62
66
68
ϕ
θ
$X_B$
y'
66
FIG. 11

METHODS AND APPARATUS FOR SEPARATING PARTICLES USING A MAGNETIC BARRIER

This is a continuation of application Ser. No. 668,080 filed Mar. 18, 1976, now abandoned.

BACKGROUND OF THE INVENTION

1. Field of the Invention

The present invention relates in general to magnetic separation and, in particular, to improved methods and apparatus for making continuous magnetic separations of flowable mixtures of particles of different magnetic susceptibilities.

2. The Prior Art

Heretofore magnetic separators have fallen generally into two classes, those which employ a katadynamic magnetic field, i.e., a field in which the magnetic force exerted on a paramagnetic particle (as used herein including ferromagnetic and ferrimagnetic particles) increases in the direction of increasing magnetic field strength, and those which employ an isodynamic magnetic field, i.e., a field in which the force exerted on a paramagnetic particle is substantially constant throughout the working area of the field. The prior art also discloses an anadynamic magnetic field, i.e., a field in which the magnetic force exerted on a paramagnetic particle decreases in the direction of increasing field strength. Uses of the anadynamic field for magnetic separation have not been broadly developed. Typically, katadynamic magnetic separators make separations by attracting particles towards the magnetic poles or by otherwise deflecting the particles from their original path of travel through the separator. They have the advantage that many pole piece configurations may be used, thereby allowing flexibility in the design and arrangement of the pole pieces to suit particular applications, and of allowing control of the magnetic force exerted on the particles to be separated by adjustment of the spacing between the pole pieces or the applied magnetic field intensity, or both. Separators of this type, however, have either brought the particles into contact with the poles, thus presenting a cleaning problem among others, or have required the use of moving elements, such as belts, discs, or the like, or a moving fluid stream to intercept particles attracted or deflected by the field and carry them out of the working area of the field for collection. In addition, prior katadynamic separators have largely been limited to the separation of ferromagnetic and paramagnetic particles. In the main, they have not been successfully applied to the separation of diamagnetic materials.

The first magnetic separator to employ an isodynamic working field was disclosed by S. G. Frantz and patented by him in U.S. Pat. No. 2,056,426, issued on Oct. 6, 1936 and assigned to the assignee of the present application. Such separators are manufactured by the S. G. Frantz Company, Inc., Trenton, New Jersey, under the trademark ISODYNAMIC. The Frantz ISODYNAMIC magnetic separator affords advantages relative to the katadynamic magnetic separator in that it permits precise separations according to magnetic susceptabilities of both paramagnetic and diamagnetic materials. It also enables separations to be made continuously and without bringing the particles into contact with the pole pieces or without requiring the use of mechanical elements or a moving fluid stream to intercept and remove the particles from the magnetic field. Unlike the katadynamic separator, however, the ISODYNAMIC separator requires specially shaped pole pieces to establish the isodynamic field. The configuration and separation of pole pieces, once determined, cannot readily be varied to allow adjustment of the magnetic force exerted on the particles without loss of the isodynamic character of the field.

The present invention is directed to the provision of improved magnetic separation methods and apparatus which combine in a unique way the advantages and capabilities of katadynamic, isodynamic, and anadynamic magnetic fields.

SUMMARY OF THE INVENTION

There is provided, in accordance with the invention, a method, and an apparatus for practicing such method, for separating a flowable mixture of particles according to the magnetic susceptibilities of the particles in which a magnetic field is established having a locus at which the magnetic energy gradient $H\partial H/\partial X$ is a maximum and in which the mixture to be separated is fed into the magnetic field in such a way as to be urged by non-magnetic forces towards the locus of maximum gradient. Particles within the mixture having a magnetic susceptibility greater than that value at which the magnetic force exerted by the maximum energy gradient on the particles balances the non-magnetic force urging the particles towards the locus of maximum energy gradient are prevented by the magnetic force from crossing from the side of the locus from which they were fed to the other side, while particles of lower magnetic susceptibility cross the locus. The locus of the maximum magnetic energy gradient thus defines a magnetic barrier along which more magnetically susceptible particles may be separated from less susceptible particles. Any suitable non-magnetic force may be used to urge the mixture towards the barrier, including, for example, gravitational, centrifugal, fluid viscous force, frictional force and the like.

In accordance with the invention, the magnetic field is established using a pair of spaced-apart pole pieces having opposing faces that are shaped in cross section to form a katadynamic field on one side of the locus of maximum magnetic energy gradient and an anadynamic field on the other side of the locus. An isodynamic field exists at the locus of maximum magnetic energy gradient. This field combination allows both paramagnetic and diamagnetic particles to be separated. When paramagnetic particles are to be prevented from crossing the magnetic barrier, the mixture is fed between the pole pieces from the anadynamic field side of the locus of maximum gradient. The paramagnetic particles will therefore move towards the barrier in opposition to the magnetic force exerted on them by the anadynamic field. When the barrier is to be used to prevent diamagnetic particles from crossing thereover, the feed direction is reversed and the particles are fed between the pole pieces from the katadynamic field side of the locus of maximum gradient. Progress of the diamagnetic particles through the barrier will therefore be opposed by the magnetic force exerted on them by the katadynamic field. The strength of the barrier is defined by the energy gradient of the isodynamic field which is the locus of the maximum energy gradient.

According to a further feature of the invention, the opposing pole faces are preferably symmetrical in cross section to provide a region in the vicinity of the plane of symmetry of the pole faces in which the magnetic energy gradient in the direction normal to the plane of symmetry is small in comparison to the maximum energy gradient defining the magnetic barrier. By feeding the mixture between the pole pieces generally along the plane of symmetry of the pole faces, the magnetic force tending to attract the particles towards either pole face is minimized. This facilitates separation of the mixture according to magnetic susceptibility and without bringing the particles into contact with the poles. If desired, the pole faces may be coated, e.g., with a corrosion resistant material, to confine particle flow to the vicinity of the plane of symmetry.

In a preferred embodiment of the invention, the pole pieces are elongated and are shaped in cross section to establish a magnetic field therebetween in which the direction of the magnetic energy gradient $H\partial H/\partial X$ is transverse to the lengthwise direction of the pole pieces and is at a maximum at a locus in the vicinity of the line of closest approach of the opposing pole faces. The mixture is fed between the pole faces so as to have velocity components in the direction of the locus of maximum gradient, i.e., the magnetic barrier, and lengthwise of the locus, so that the particles deflected by the barrier move lengthwise thereof to a downstream point where they may be collected separately from the particles which cross the barrier. Preferably, provision is made for control of the angle of approach of the particles towards the barrier to permit adjustment of the magnitude of the velocity component which must be opposed by the magnetic force of the barrier. This arrangement enables continuous separations to be effected by providing for continuous movement of the particles through the magnetic field and for continuous collection of the magnetic and non-magnetic fractions. In a convenient arrangement, flow of the mixture through the magnetic field is confined within an elongate flow channel positioned between the pole pieces in generally parallel alignment therewith. The pole pieces and the flow channel are inclined to the horizontal both in the transverse direction and in the lengthwise direction, with the result that the mixture is urged by gravity along a path of travel which crosses the locus of maximum gradient. Particles deflected by the barrier, however, are diverted from such flow path and flow through the channel along the locus of the barrier. Separate particle outlets from the channel permit separate collection of the magnetic and non-magnetic fractions. Desirably, the flow channel is located generally along the plane of symmetry of the pole faces so as to minimize the magnetic force on the particles in the direction normal to the plane of flow channel.

As another feature of the invention, provision may be made for varying the magnitude of the maximum magnetic energy gradient along the length of its locus. This may be done in several ways, including varying the spacing between the opposing pole faces along the line of closest approach therebetween, varying the intensity of the magnetic field, and varying the shape of the pole faces which create the katadynamic, isodynamic and, anadynamic fields. In one such arrangement, the barrier height may be maintained at the maximum value and substantially uniform over an upstream region of the magnetic field and then caused to decrease in a downstream region. The particles which do not cross the barrier move lengthwise along the barrier in the upstream field region but are released to pass through the barrier, for collection purposes, upon reaching the downstream region.

In another embodiment, a plurality of pairs of pole pieces may be arranged in side by side relation to establish a succession of magnetic barriers. By feeding the mixture through these barriers in succession, particles of different magnetic susceptibilities may be deflected and subsequently collected, along each barrier.

BRIEF DESCRIPTION OF THE DRAWINGS

For a better understanding of the invention, reference may be made to the following detailed description of exemplary embodiments thereof, taken in conjunction with the accompanying drawings, in which:

FIG. 9*a* is a schematic view of a flow channel and magnetic barrier arrangement for separating paramagnetic particles in accordance with the invention;

FIG. 9*b* is a diagram of the magnetic and gravitational forces acting on particles in the separator arrangement of FIG. 9*a;*

FIG. 10*a* is a schematic view of a flow channel and magnetic barrier arrangement for separating diamagnetic particles in accordance with the invention;

FIG. 10*b* is a diagram of the forces acting on particles in the separator arrangement of FIG. 10*a;*

FIG. 11 is a schematic view of a flow channel and magnetic barrier arrangement in which the barrier strength progressively decreases in the downstream direction;

DETAILED DESCRIPTION

For convenience, exemplary embodiments of the invention are described herein by reference to the separation of dry flowable mixtures. It will be understood that the invention is likewise applicable to the separation of particles suspended in a liquid carrier. For example, water, solvent, colloidal suspensions of magnetic particles or other magnetic fluids such as solutions of paramagnetic substances may be used.

Figure 1:
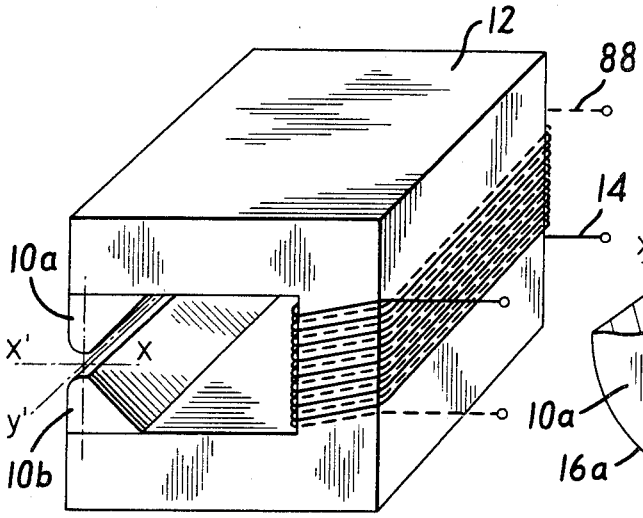
FIG. 1 is a representation of a magnetic circuit useful in establishing a magnetic field in accordance with the invention.

FIG. 1 depicts in schematic form the magnetic circuit of a separator, including the opposed pole pieces 10*a* and 10*b*, a U-shaped core 12 and a winding 14. The winding 14 is adapted to be connected to a conventional source (not shown) of d.c. current. Alternatively, the core and winding and also the poles if so desired could be replaced by a permanent magnet or magnets. In this case the field strength may be varied by adjusting the reluctance of the magnetic circuit. As shown in enlarged detail in FIGS. 2*a* and 2*b*, the pole pieces 10*a* and 10*b* are elongated in the direction of axis y—y' and have opposing faces 16*a* and 16*b* which are symmetrical in cross section relative to a plane of symmetry x—x'. For the purpose of establishing a reference system useful in describing the invention hereinafter, the point along axis y—y' coinciding with the remote end of pole pieces 10*a* and 10*b* has been designated in FIG. 2*a* as the zero point and the point therealong which coincides with the near end of the pole pieces has been designed $y_1$.

Figure 2A:
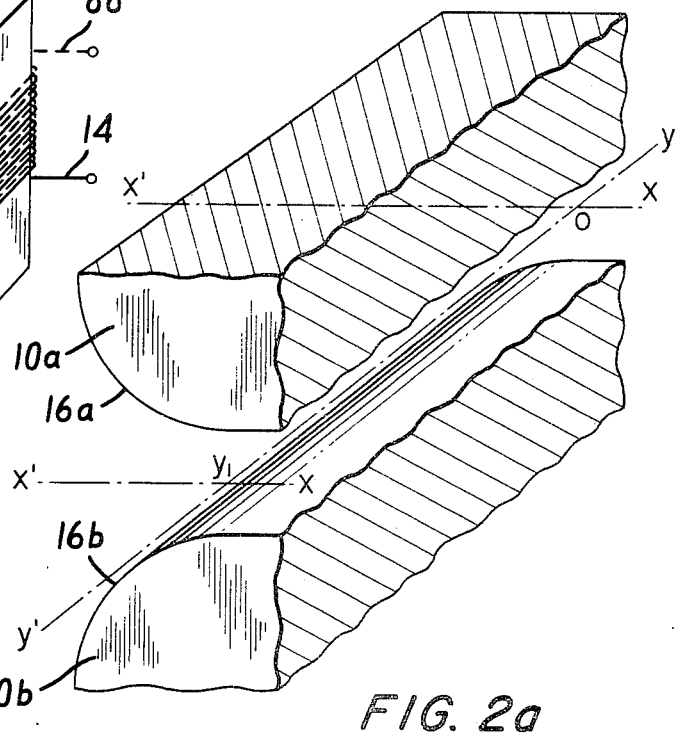
FIGS. 2*a* and 2*b* are enlarged schematic views of the pole pieces of the magnetic circuit of FIG. 1.
Figure 2B:
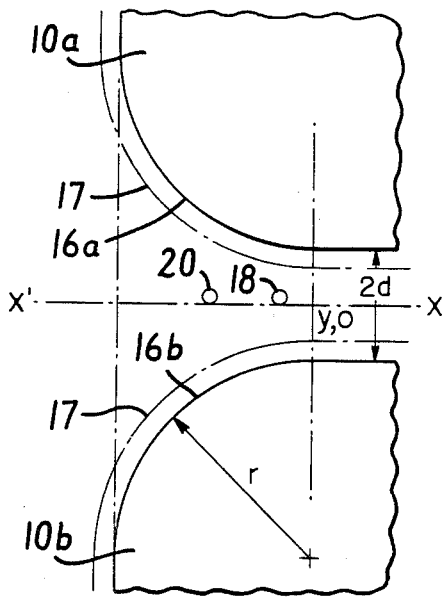

FIG. 2*b* depicts the pole pieces of FIG. 2*a* looking down the y—y' axis. Since, as noted, the opposing pole faces 16*a* and 16*b* are symmetrical relative to the x—x' plane, the magnetic energy gradient in the direction normal to the x—x' plane, and hence the net magnetic force exerted on particles, such as indicated at 18 and 20 in FIG. 2*b*, lying on or near the x—x' plane, is much smaller than the magnetic energy gradient and the resulting net magnetic force acting on the particles in the direction of the x—x' plane. Consequently, there will be little tendency for the particles 18 and 20 to move in the direction of either pole piece 10*a* or pole piece 10*b*. The present invention allows full advantage to be taken of this characteristic, as described in more detail hereinafter, by permitting introduction of the particles into the magnetic field generally along the plane of symmetry x—x' of the opposing pole pieces. In this connection, each of the pole faces 16*a* and 16*b* may be covered with a corrosion resistant coating 17 which is of a thickness such that particle flow between the pole pieces is confined to the vicinity of the plane of symmetry x—x'. Where such a corrosion resistant coating is provided, all of the parts of the separator which come into contact with the flowable mixture may similarly be coated.

The pole faces 16*a* and 16*b* are also preferably shaped in cross section to define over adjacent regions thereof a katadynamic magnetic field and an anadynamic magnetic field separated by an isodynamic field. Various pole face configurations may be used for this purpose. For simplicity, the pole faces 16*a* and 16*b* are shown in FIG. 2*b* as being defined by a quarter circle of radius r which merges at its ends into tangential surfaces. As depicted in FIG. 2*b*, the plane passing through the inner ends of the quarter circle portions of faces 16*a* and 16*b* passes through the y—y' axis, whereby the $y_1$–O line along the pole faces defines their line of closest approach. The distance of such closest approach, hereinafter referred to as the gap between the pole pieces, is designated in FIG. 2*b* as 2*d*.

Figure 3B:
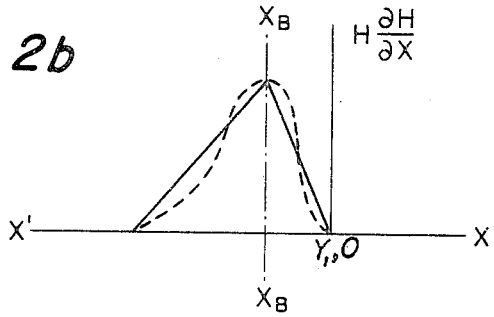
FIGS. 3*a*, 3*b* and 3*c* are graphical representations of the variations over the cross section of the pole pieces of FIGS. 2*a* and 2*b* of certain parameters of the magnetic field established between the pole faces.
Figure 3A:
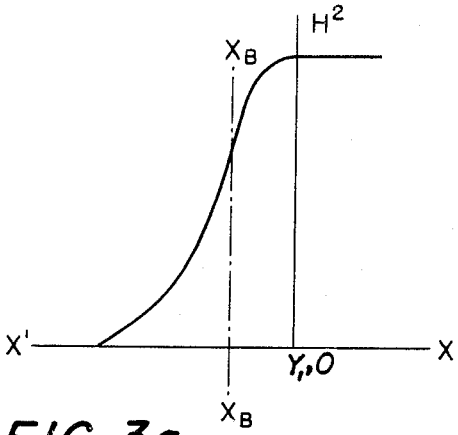

FIG. 3*a* depicts the variation of the square of the magnetic field strength $H^2$ and FIG. 3*b* depicts the gradient of the square of the field strength $H\partial H/\partial X$, defined herein as the magnetic energy gradient, produced by the pole faces 16*a* and 16*b* along the plane of symmetry x—x'. As shown in FIG. 3*a*, $H^2$ increases toward the right until the line $y_1$–O is reached, at which point it becomes uniform owing to the parallel planar nature of the pole faces to the right of the $y_1$–O line. The dashed line curve of FIG. 3*b* indicates that the gradient $H\partial H/\partial X$ increases toward the right until the point of inflection of the $H^2$ curve (FIG. 3*a*) and thereafter decreases to zero at the $y_1$–O line. To the right of the $y_1$–O line the energy gradient $H\partial H/\partial X$ is zero because the field is uniform over that that region. An isodynamic field at the locus of maximum energy gradient $H\partial H/\partial X$ defines the strength of the magnetic barrier which extends lengthwise of the pole pieces in the vicinity of the line of their closest approach $y_1$–O. The locus of the maximum magnetic energy gradient, which defines the position of the barrier, is identified in FIGS. 3*a* and 3*b*, and in later views, by the designation $X_B$. For convenience of illustration herein, the dashed-line gradient curve of FIG. 3*b* is approximated by two straight lines which connect the peak or maximum gradient value with the zero points on either side of the locus $X_B$.

The magnetic forces exerted on a small paramagnetic particle by an applied field (assuming a single dimensional case) is given by:

$$F_M = KvH\partial H/\partial X = \tfrac{1}{2}Kv\partial H^2/\partial X \qquad (1)$$

where $F_M$ is the magnetic force (dynes),

K is the volume susceptibility, v is the volume of the particle ($cm^3$),

H is the magnetic field intensity (Oe.)

$\partial H/\partial X$ is the field gradient along the x—x' plane (Oe./cm), and $\frac{1}{4}\pi H\partial H/\partial X$ is the magnetic energy gradient ($Oe.^2/cm$).

By convention paramagnetic particles are considered to have positive K values and diamagnetic materials are considered to have negative K values. The magnetic forces exerted on a paramagnetic particle 18 and a diamagnetic particle 20 located between the pole pieces 10*a* and 10*b* (FIG. 2*b*) may therefore be represented in the manner shown in FIG. 3*c*. The maximum magnetic force for either particle occurs at the locus $X_B$ of the maximum value of the gradient $H\partial H/\partial X$. for the paramagnetic particle 18, this force, indicated by the curve 22 in FIG. 3*c*, increases in the direction of increasing field strength $H^2$ and is considered to be a positive force. The force exerted on diamagnetic particle 20, indicated by curve 24 in FIG. 3*c*, on the other hand, decreases in the direction of increasing field strength $H^2$ and is considered to be a negative force. Accordingly, the magnetic force $+F_M$ acting on paramagnetic particle 18 is toward the right in FIG. 3*c* while the magnetic force $-F_M$ acting on diamagnetic particle 20 is toward the left. In accordance with the aforementioned definitions, therefore, it may be seen from FIG. 3*c* that the magnetic field established between the pole pieces 10*a* and 10*b* is katadynamic over the region to the left of the $X_B$ of the maximum gradient $H\partial H/\partial X$, anadynamic over the region to the right of $X_B$, and isodynamic at $X_B$. It will also be appreciated that the magnetic energy gradient $H\partial H/\partial X$, by virtue of the force which it exerts on particles coming within the field, defines a magnetic barrier along the locus $X_B$ against the movement thereacross of particles which are subject to a non-magnetic force insufficient to overcome the opposing magnetic force exerted by the barrier. Since the maximum magnetic force is exerted along the locus of maximum gradient, the magnitude or value of the maximum gradient is herein described and represented in the drawings as the barrier. It should be understood that the barrier does not have physical height but consists of a region in the vicinity of the x—x' plane where the magnetic force exerted in the direction of increasing magnetic field on paramagnetic particles and in the reverse direction on diamagnetic particles reaches a maximum.

Figure 3C:
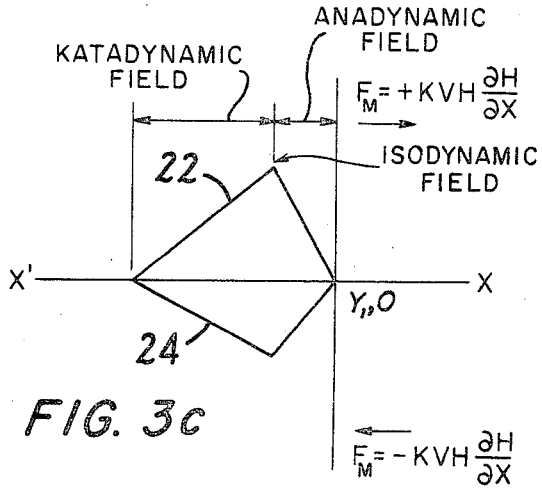
Figure 4A:
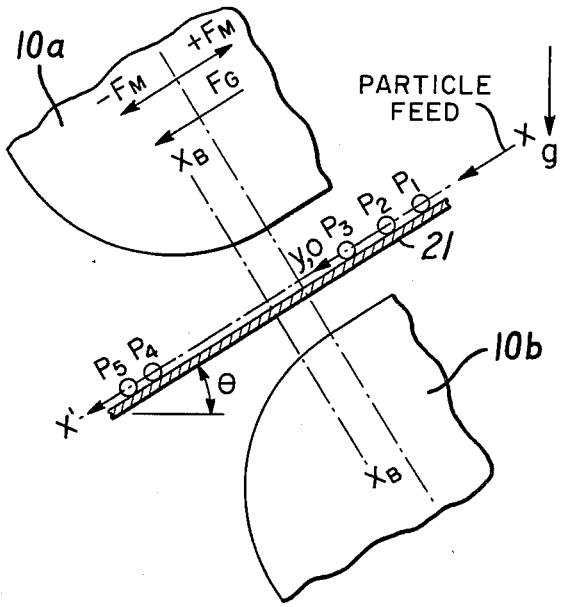
FIG. 4*a* is a schematic view of the pole pieces of FIGS. 2*a* and 2*b* as arranged to deflect paramagnetic particles along the magnetic barrier established therebetween against the force of a gravity particle feed.

The manner in which the force illustrated in FIG. 3*c* may be used to separate particles according to their magnetic susceptibilities may be further understood from consideration of FIGS. 4*a* and 4*b* and FIGS. 5*a* and 5*b*. In FIG. 4*a*, the pole pieces 10*a* and 10*b* have been tilted such that the plane of symmetry x—x' is inclined at an angle $\theta$ to the horizontal. If a group of five particles $P_1$, $P_2$, $P_3$, $P_4$ and $P_5$, having decreasing susceptibilities $K_1>K_2>K_3>K_4>0>K_5$, respectively, is introduced between the pole pieces from the right along a surface 21, lying in or near the x—x' plane, all of the particles will be urged downward along the surface by a gravitational force $F_G=mg \sin \theta$, where m is the mass of the particle, g is the acceleration due to gravity and $\theta$ is the angle of tilt from the horizontal. Particles $P_1$ to $P_4$ will be opposed in such movement by a magnetic force $+F_M$ proportional to their susceptibilities $K_1$ to $K_4$, and the particle $P_5$ will experience additional downward force $-F_M$. If the magnitude of the gravitational force $F_G$ is superimposed on a plot of the magnetic forces acting on the respective particles, as has been done in FIG. 4*b*, it may be seen that those particles having a susceptibility K greater than the susceptibility at which the upwardly acting magnetic force $F_M$ *balances the downwardly acting gravitational force* $F_G$ will be retained on the right hand side of the barrier locus $X_B$, but that particles of lesser susceptibility or of a negative susceptibility will cross the barrier locus $X_B$ and continue downward along the surface 21.

The criterion determining whether a particle will be deflected by the magnetic barrier or whether it will penetrate the barrier may be expressed as:

$$F_{NM}=K_O v(H\partial H/\partial X)_{max} \quad (2)$$

where $F_{NM}$ is the applied non-magnetic force ($F_G$ in FIG. 4*a*) tending to urge the particles in the direction of the barrier;

$K_0$ is that value of magnetic susceptibility at which, for a constant magnetic energy gradient $H\partial H/\partial X$, the magnetic force acting on a particle will just balance the applied non-magnetic force; and $(H\partial H/\partial X)_{max}$ is the maximum value of the magnetic energy gradient $H\partial H/\partial X$.

For a constant applied non-magnetic force $F_{NM}$ and constant maximum barrier strength $(H\partial H/\partial X)_{max}$, particles with susceptibilities greater than $K_0$ will be deflected by the barrier while particles of lower susceptibilities will penetrate the barrier. As will be apparent, this criterion affords a basis for separating particles according to their magnetic susceptibilities.

Figure 4B:
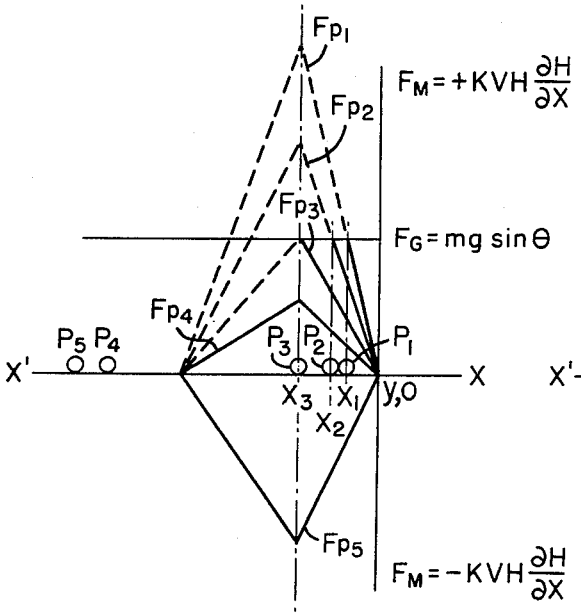
FIG. 4*b* is a graph of the magnetic forces acting on the particles fed between the pole pieces of FIG. 4*a;*

Turning to FIG. 4*b*, it may be seen that the particle $P_3$, which has a susceptibility $K_3$ equal to $K_0$ for the barrier of FIG. 4*a*, will undergo a magnetic force $F_{p3}$ which just balances the gravitational force $F_G$ and that the particle $P_3$ will therefore be prevented from crossing from one side of the barrier to the other side at a balance point $X_3$ which coincides with the locus $X_B$ of the barrier. The particles $P_1$ and $P_2$, having still higher magnetic susceptibilities $K_1$ and $K_2$, will be subject to the stronger magnetic forces $F_{p1}$ and $F_{p2}$, respectively, and will be deflected at balance points $X_1$ and $X_2$. The less strongly paramagnetic particle $P_4$, however, which has a susceptibility $K_4$ lower than $K_0$, will experience a magnetic force $F_{p4}$ which is insufficient to balance the gravitational force $F_G$, with the result that particle $P_4$ will cross the barrier locus $X_B$. The diamagnetic particle $P_5$, having a negative susceptibility $K_5$, will be subject to a negative magnetic force $F_{p5}$ and will of course pass through the barrier. Diamagnetic particles approaching the barrier in FIG. 4*a* from the right will always pass through the barrier.

Figure 5A:
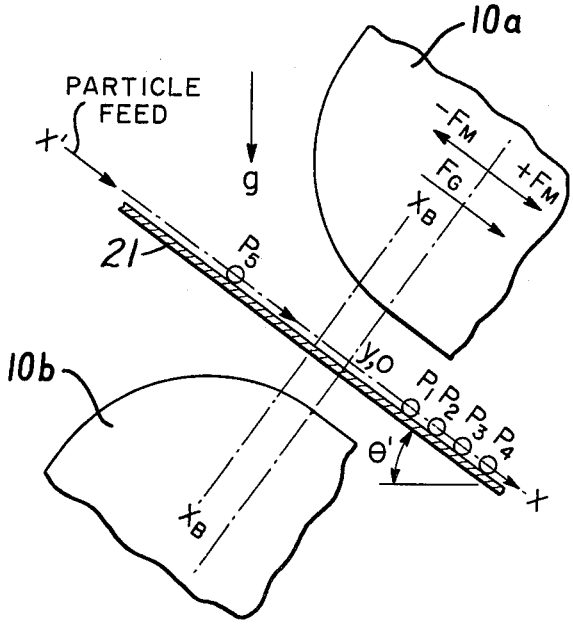
FIG. 5*a* is a schematic view of the pole pieces of FIGS. 2*a* and 2*b* as arranged to deflect diamagnetic particles along the magnetic barrier established therebetween against the force of a gravity particle feed.
Figure 5B:
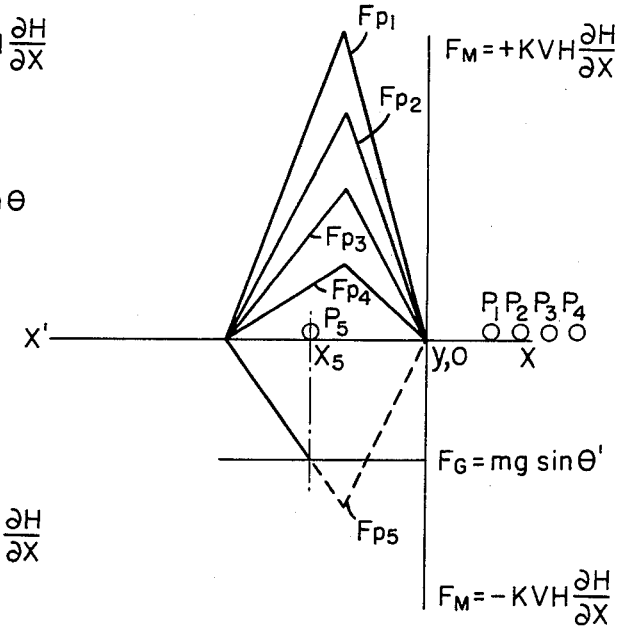
FIG. 5*b* is a graph of the magnetic forces acting on the particles fed between the pole pieces of FIG. 5*a;*

FIGS. 5*a* and 5*b* depict a separator arrangement for deflecting diamagnetic particles on the magnetic barrier. In this arrangement, the pole pieces 10*a* 10*b* are tilted in the opposite direction from that of FIG. 4*a*, such that the x—x' plane is inclined to the left at an angle $\theta'$, and the particles $P_1$ to $P_5$ are fed along the surface 21 from the left hand side of the barrier locus $X_B$. The paramagnetic particles $P_1$ to $P_4$ will be urged downward to the right by both the magnetic forces $F_{p1}$ to $F_{p4}$, see FIG. 5*a*, and the gravitational force $F_G$. They will therefore cross the barrier locus $X_B$ without resistance. The diamagnetic particle $P_5$, by contrast, will be opposed by the upwardly acting magnetic force $F_{p5}$, and, assuming its susceptibility $K_5$ is more diamagnetic than $K_0$ for the barrier, will be deflected by the barrier at the balance point $X_5$, as shown in FIG. 5*b*.

It has been assumed in the above discussion of FIGS. 4*a* and 5*a* that the barrier strength, i.e., the maximum value of the magnetic gradient $H\partial H/\partial X$, was held constant. This condition, with a constant applied non-magnetic force $F_{NM}$, gives a separation into two fractions, one having susceptibilities greater than $K_0$ and the other having susceptibilities less than $K_0$. If, however, the barrier strength is varied while maintaining the applied non-magnetic force constant, it is possible to vary the value of $K_0$ at which the barrier will be effective to deflect particles and thereby obtain multiple fractions of different susceptibilities.

Figure 6A:
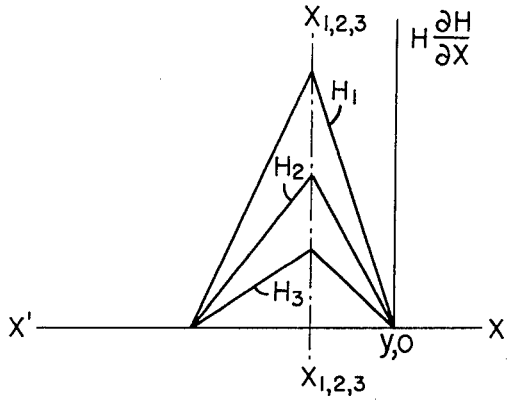
FIGS. 6*a*, 6*b* and 6*c* illustrate various ways in which the strength of the magnetic barrier may be varied.
Figure 6B:
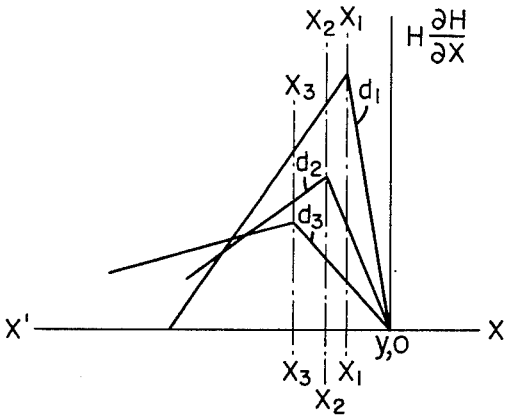
Figure 6C:
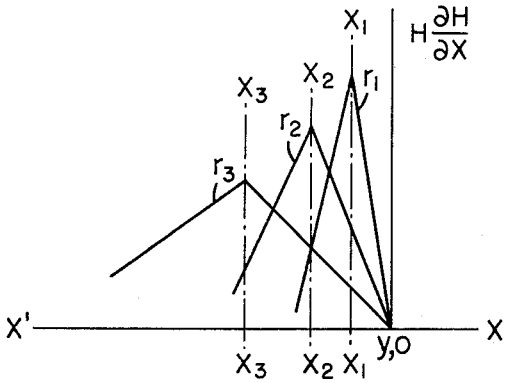

Three ways in which the barrier strength may be varied are illustrated in FIGS. 6*a*, 6*b* and 6*c*, namely, by varying the strength of the applied field, by varying the spacing or gap between the pole pieces, and by varying the cross sectional shape of the opposing pole faces. FIG. 6*a* depicts three barrier strengths corresponding to three different field strengths $H_1$, $H_2$ and $H_3$, where the gap and the pole face shape are unchanged. The strength of the barrier $H\partial H/\partial X$ increases with increasing field strength, but changes in the strength of the barrier do not significantly change its locus.

In FIG. 6*b*, the shape of the pole pieces and the applied field strength H have been kept unchanged and the barrier strength varied by changing the gap 2*d* between the pole pieces. The barriers corresponding to three gaps $d_1$, $d_2$ and $d_3$ are represented, with $d_1$ being the smallest gap and $d_3$ the largest gap. It may also be seen from FIG. 6*b* that the locus $X_1$, $X_2$ and $X_3$ of the respective barriers shifts to the right, i.e., toward the line of closest approach of the pole pieces, with decreasing gap size.

FIG. 6c depicts the condition where field intensity and gap size are kept constant and the shape of the pole faces is varied, as, for example, by varying the radius r of the quarter circle portion of the faces. In FIG. 6c, $r_1$ represents the smallest radius and $r_3$ the largest radius, from which it will be apparent that the strength of the barrier increases as the radius decreases. Here again, the locus $X_1$, $X_2$ and $X_3$ of the respective barriers shifts toward the line of closest approach as the radius of curvature of the pole faces is decreased.

Figure 7:
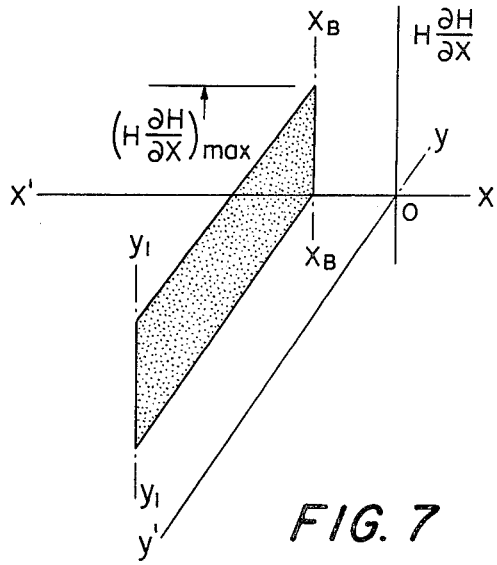
FIG. 7 is a pictorial representation of a magnetic barrier created in accordance with the invention in which the strength of the barrier is shown as height at the locus of maximum energy gradient.

With reference to FIG. 7, the magnetic barrier established in accordance with the invention, and specifically the barrier established by the pole piece arrangement of FIGS. 2a and 2b, may be visualized as a virtual planar member of finite extent, having a locus $X_B$ along the x—x' axis, a strength ($H\partial H/\partial X$) max. shown as the height, and a length parallel to the y—y' axis from O to $y_1$. The pole pieces are not shown in FIG. 7 for clarity. Since the gap between the pole pieces 10a and 10b in the arrangement of FIGS. 2a and 2b is uniform over the full length of the pieces and since the cross sectional shape of the pole faces 16a and 16b are likewise uniformly shaped over the full length of the pole pieces, the barrier established between the pole pieces will be of a uniform strength over the full length of the pole pieces.

Figure 8A:
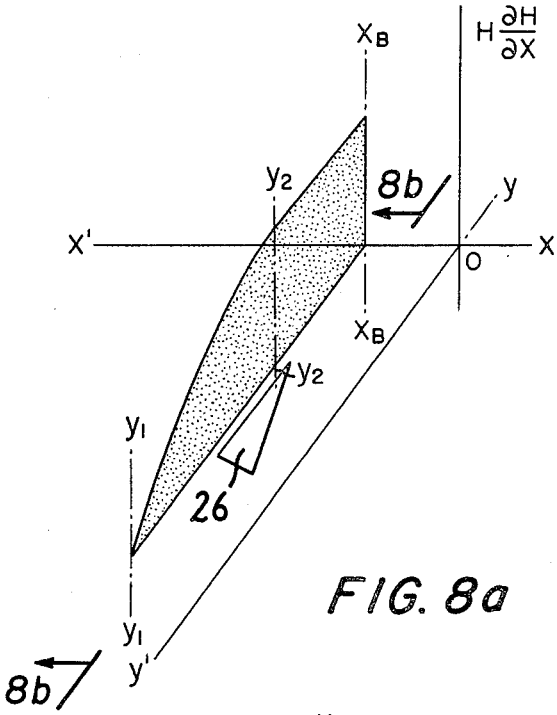
FIG. 8*a* is a pictorial representation of a magnetic barrier having a substantially uniform strength in an upstream region of the magnetic field and a decreasing strength in a downstream region of the field.

FIG. 8a shows a barrier in which the strength is at a maximum and uniform over the lengthwise region O–$y_2$ and gradually decreases over the lengthwise region $y_2$–$y_1$. Such a barrier configuration is useful in making continuous separations of a flowable mixture in which the mixture is given velocity components both toward the barrier and along its length, i.e., in the direction of the y—y' axis. Since the direction of the magnetic force generated by the barrier is perpendicular to the barrier, the particles will encounter no resistance to lengthwise movement along the barrier. Hence the particles will be guided by the barrier to a downstream point where they may be collected. This point is depicted in FIG. 8a at $y_2$, downstream of which the barrier strength falls off. As the particles prevented from crossing the barrier pass the point $y_2$ they will begin to pass through the barrier as the barrier strength decreases. They may thereupon be intercepted by one or more dividers 26 and guided to a suitable collecting receptacle (not shown).

Figure 8B:
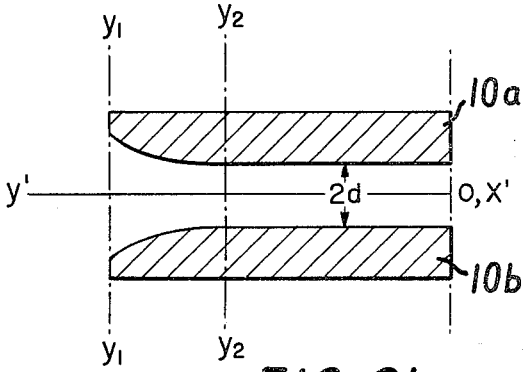
FIG. 8*b* is a cross-sectional view of pole pieces useful in producing the magnetic barrier of FIG. 8*a;*

Pole pieces 10a and 10b useful in establishing the barrier configuration of FIG. 8a are shown in lengthwise cross section in FIG. 8b. As there illustrated, the decrease in barrier strength over the downstream region $y_2$–$y_1$ is achieved by progressively increasing the gap 2d in the direction from point $y_2$ to point $y_1$. It will be understood that the variation in barrier strength over the region $y_2$–$y_1$ may also be accomplished by varying the shape of the opposing pole faces.

The mixture of particles may be urged towards and along the magnetic barrier by any suitable non-magnetic force, including, for example, gravitational force, centrifugal force, fluid viscous force, frictional force and the like. Various representative separator arrangements for separating particles according to their magnetic susceptibilities by means of opposing magnetic force to gravitational force are illustrated in FIGS. 9a, 10a, 11 and 12a. For clarity of illustration of the magnetic barriers and the flow of particles relative thereto, the pole pieces have been omitted from these views.

FIG. 9a presents a separator arrangement suitable for separating paramagnetic particles. It includes an elongated non-magnetizable flow channel 28 of generally U-shaped cross section positioned between the pole pieces (not shown) in generally parallel alignment therewith. Preferably, the channel is located such that its transverse plane is in or near the plane of symmetry x—x' of the pole pieces.

As shown in FIG. 9a, the channel 28 has a transverse slope to the left at an angle $\theta$ and a lengthwise or forward slope at an angle $\phi$. The angle $\phi$ is measured in the plane normal to the transverse plane of the channel 28. The magnetic barrier 30 extends lengthwise of the channel 28 and is of a uniform strength over substantially the full length thereof.

The forces acting in the plane of the channel on a paramagnetic particle moving downward therealong, such as the particle 32 in FIG. 9a, are shown in FIG. 9b. A gravitational force component $F_G$ acts along the x—x' plane towards the left in FIGS. 9a and 9b. For the separator arrangement of FIG. 9a, this component is given by:

$$F_{GX}=mg \sin \theta \quad (3)$$

where g is the gravitational acceleration constant, and m is the mass of the particle.

The transverse gravitational component $F_{GX}$ is opposed by the magnetic force $F_M$ which acts at right angles to the barrier 30 and, for paramagnetic particles, in the opposite direction from $F_{GX}$. As discussed above in connection with FIGS. 4a and 5a, those particles, such as particles 34 in FIG. 9a, having magnetic susceptibilities greater than the $K_o$ value of barrier 30 will be deflected by the barrier 30 on the righthand side of the barrier locus $X_{B'}$, while more weakly paramagnetic particles and diamagnetic particles, such as are indicated at 36 in FIG. 9a, will cross the barrier 30 under the influence of the gravitational force component $F_{GX}$. By virtue of the forward slope $\phi$ of the channel 28, the particles, referring here again to particle 32 in FIG. 9a by way of example, will also have a lengthwise gravitational force component $F_{GY}$ acting along the y—y' plane. $F_{GY}$ will be of a magnitude given by:

$$F_{GY}=mg \cos \theta \sin \phi \quad (4)$$

Since the magnetic barrier 30 does not impede particle movement in the y—y' direction, the particles will flow lengthside of flow channel 28 generally along two separate paths, one for the particles 34 which do not pass the barrier and the other for the particles 36 which pass through the barrier. The two distinct groups of particles may therefore be readily recovered at the downstream end of the flow channel 28. To that end, a guide member 38 may be provided on the downstream side of the barrier 30. Another divider 39 may be provided on the upstream side of the barrier 30 at the upstream end of the channel 28 to facilitate proper particle feed into the channel.

As may be appreciated from FIGS. 9a, 9b, 10a and 10b the magnetic force produced by a magnetic barrier opposes the component of the non-magnetic force acting perpendicular to the barrier. For a constant magnitude non-magnetic force, the magnitude of this component is controlled by the angle between the direction of the resultant non-magnetic force and the magnetic barrier, i.e., the angle of approach of the particles towards the barrier. As this angle becomes smaller the component of the non-magnetic force which the magnetic force opposes becomes smaller and less susceptible magnetic particles will be deflected along the barrier. The susceptibility $K_o$ at which particles will be prevented from crossing the barrier may therefore also be controlled by appropriate selection of the angle of approach of the particles towards the barrier.

FIG. 10*a* depicts a separator arrangement similar to that of FIG. 9*a* but arranged such that the barrier 40 thereof will deflect diamagnetic particles. Whereas in FIG. 9*a* the flow channel 28 was inclined so as to have a transverse slope to the left, in FIG. 10*a* the flow channel 42 is inclined by an angle $\theta$ to have a transverse slope to the right. The chute 42 is also inclined in the forward direction at an angle $\phi$, as measured in a plane normal to the plane of the channel. The particle mixture is fed to channel 42 on the lefthand side of barrier 40, for which purpose a divider 44 may be provided. The forces acting on diamagnetic particles flowing along channel 42, such as particle 45, are represented in FIG. 10*b*.

Those diamagnetic particles 46 having a diamagnetic magnetic susceptibility greater than that value at which the magnetic force $F_M$, acting normal to the barrier 40 and to the left in FIG. 10*a*, balances the rightwardly acting transverse gravitational force $F_{GX}$ will be prevented from passing the barrier 40, whereas less susceptible diamagnetic particles and paramagnetic particles, indicated at 48 in FIG. 10*a*, will cross to the righthand side of the barrier. A guide member 50 at the downstream end of channel 42 provides for separate collection of the two fractions 46 and 48 of particles. In this instance, the guide member 50 is located on the righthand side of the barrier 40.

FIG. 11 illustrates a separator arrangement generally similar to that of FIG. 10*a* except that the strength of the magnetic barrier 52 progressively decreases from the upstream end to the downstream end of flow channel 54. The diamagnetic particles fed to the channel 54 will therefore progressively cross over the barrier 52, in the course of their downstream movement therealong, in accordance with their magnetic susceptibilities. This arrangement, therefore, permits a number of fractions of different magnetic susceptibilities to be obtained. For instance, the most weakly susceptible particles and any paramagnetic particles in the mixture, such as the particles 56 in FIG. 11, will cross the barrier 52 in a comparatively upstream region of the channel 54 and may be guided from the channel 54 along a separate path formed by the guide members 58 and 60.

Particles having sufficient diamagnetic susceptibility to be initially retained by the barrier 52 but which are not sufficiently susceptible to be retained as the barrier strength decreases along the length of the channel 54 will cross the barrier at that position along its length at which the magnetic force on the particle at the barrier has decreased and no longer exceeds the gravitational opposing force. Thus, in FIG. 11, the particles 62 which are collected between the guide members 60 and 64 will be understood to be more diamagnetic than particles 56 collected between the more upstream guide members 58 and 60, and the particles 66 collected between the guide members 64 and 68 will be more diamagnetic than particles 62. Those particles, indicated at 70 in FIG. 11, having a sufficiently high diamagnetic susceptibility to be prevented from crossing the barrier 52 over substantially the full length of the channel 54 will be collected to the left of the guide member 68. In the embodiment of FIG. 11, therefore, four separate fractions may be obtained from the particle mixture by use of a single pair of pole pieces.

Figure 12A:
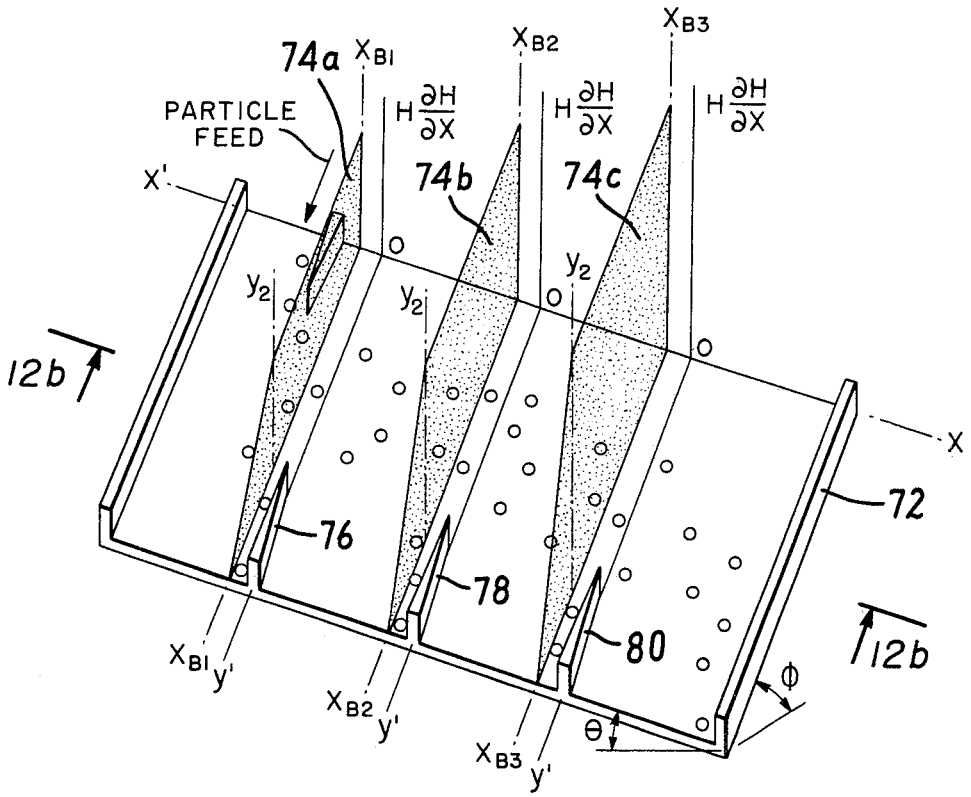
FIG. 12*a* is a schematic view of a flow channel and magnetic barrier arrangement in which a succession of magnetic barriers of progressively increasing strengths are provided.

A separator arrangement in which a plurality of pairs of pole pieces, and hence a plurality of magnetic barriers, may be used to produce multiple fractions of different magnetic susceptibilities is depicted in FIG. 12*a*. In this arrangement, a flow channel 72 of expanded width and the associated pole pieces (not shown in FIG. 12*a*) are inclined to the horizontal in the transverse and lengthwise directions in the same manner as has been explained in connection with FIG. 10*a*. Three magnetic barriers 74*a*, 74*b* and 74*c* are located in side-by-side parallel relation across the transverse extent of the flow channel. Each barrier has a configuration similar to that depicted in FIG. 8*a* but is of a different strength, with the barrier strength progressively increasing from barrier 74*a* to barrier 74*c*. The particle mixture is fed to the channel 72 adjacent the upper lefthand corner thereof so that the particles not retained by barrier 74*a* will flow through the downstream barriers in succession as they progress along the flow channel. Diamagnetic particles having diamagnetic susceptibilities greater than the $K_0$ of barrier 74*a* will be deflected by that barrier and be guided therealong lengthwise of the channel 72 until collected by the guide member 76 downstream of point $y_2$. Less diamagnetic particles will pass through barrier 74*a* and, by virtue of the gravitational force component acting transversely of channel 72, approach barrier 74*b*. Since barrier 74*b* has a greater strength than 74*a*, it will deflect particles of lower diamagnetic susceptibility than would barrier 74*a*. Accordingly, another fraction of particles may be collected downstream of point $y_2$ by use of a guide member 78. Particles of still less diamagnetic susceptibility cross barrier 74*b* and are urged towards barrier 74*c*. Since barrier 74*c* has a higher strength than barrier 74*b*, it will deflect still less diamagnetically susceptible particles, which particles may be separately collected along a guide member 80. Any particles in the mixture having diamagnetic susceptibilities lower than the $K_0$ of barrier 74*c* or any paramagnetic particles in the mixture will continue on across the flow channel 72 and may be collected along the righthand side of the channel. The arrangement of FIG. 12*a* thus provides in a continuous manner four separate fractions of particles of different magnetic susceptibilities.

Figure 12B:
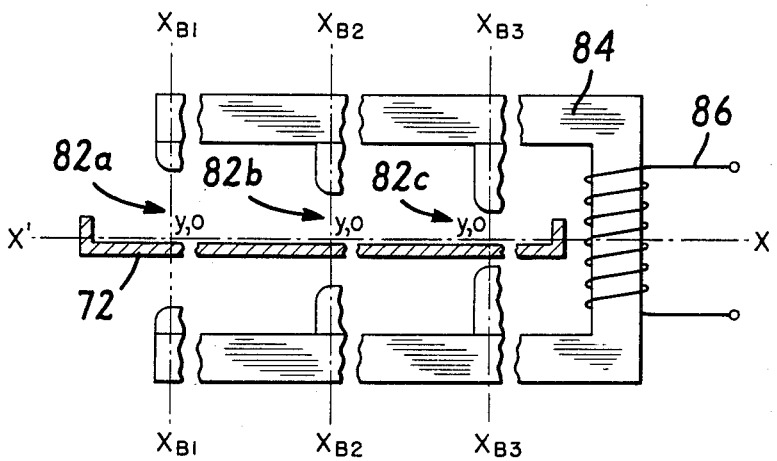
FIG. 12*b* is a schematic view of a magnetic circuit useful in generating the magnetic barriers depicted in FIG. 12*a*, with parts broken away for clarity of illustration.

A magnetic circuit suitable for creating the barriers 74*a*, 74*b* and 74*c* of FIG. 12*a* is shown in schematic form in FIG. 12*b*. It includes three pairs 82*a*, 82*b* and 82*c* of opposed pole pieces, a U-shaped core 84 and a winding 86. The pole pieces have the cross sectional shape shown in FIGS. 2*a* and 2*b* and are spaced along the legs of the core 84 in side-by-side parallel relation. The flow channel 72 is located between the pole pieces such that the plane of the channel is in the region of the plane of symmetry x—x′ of the pole faces. By employing progressively smaller gaps between pole piece pair 82*a*, pair 82*b* and pair 82*c*, the strengths of the associated barriers 74*a*, 74*b* and 74*c*, respectively, may be progressively increased in the manner illustrated in FIG. 12*a*. As noted in connection with FIG. 6*c*, like variation in barrier strength can be achieved by using three different radii of curvature for the opposing pole faces of the three pole pairs.

A number of barriers can be provided in the gap of one magnetic circuit. The pole piece pairs producing the barriers may be stacked in tiers with a number of pairs in each tier. The particles can be fed so that the flow stream is divided into a number of parts at every tier and each part of the flow stream passes through one or more barriers successively, and the separated particles can be collected in such a manner that magnetic particles are discharged at one exit from the separator and non-magnetic particles are discharged at another exit. Such an arrangement provides means for continuous processing of a substantial volume of material.

The magnetic circuits of FIGS. 1 and 12*b* are useful for separating materials based on their natural magnetic properties. However, the invention may also be employed to make separations on the basis of induced magnetic susceptibilities. Accordingly, the circuit of FIG. 1 may be modified to include a second winding 88 adapted to be connected to a suitable source (not shown) of a.c. current. Superimposed a.c. and d.c. magnetic fields will thereby be created. The a.c. field will generate eddy currents in conducive particles passing through it which in turn will produce an induced magnetic field within the particles. The d.c. magnetic field will, as discussed above, establish the magnetic barrier. The barrier will act to deflect particles in accordance with their induced susceptibilities or, more precisely, according to the conductivity and shape of such particles.

Where separations are to made in a liquid carrier, the same analysis used in the dry separation can be used, except the magnetic susceptibility term K in equation (1) becomes $(K-K_L)$, where $K_L$ is the magnetic susceptibility of the liquid. The magnetic force exerted on a particle by an applied field would then become:

$$F_M = (K - K_L)\frac{vH\partial H}{\partial X} \quad (5)$$

and it can be used to oppose a non-magnetic force, for example, the gravitational force.

If the same apparatus shown in FIG. 9*a* is used, then the non-magnetic force opposing the magnetic force along the plane x—x′ becomes:

$$F_{NM}=(d_p-d_L)\ vg \sin\theta \quad (6)$$

where $d_p$ is the density of the particle; and $d_L$ is the density of the liquid carrier.

When $F_M$ (equation (5)) exceeds $F_{NM}$ (equation (6)), the particles are deflected by the barrier, and $$F_M = (K - K_L)\ v(H\frac{dH}{dX})\ \text{max.} \quad (7)$$

and exceeds $$F_{NM}=(d_p-d_L)\ vg \sin\theta \quad (8)$$

If K is much larger than $K_L$ then $K-K_L=K$ (approximately) and $$Kv\ (H\frac{dH}{dX})\ \text{max.}$$

exceeds $(d_p-d_L)Vg \sin\theta$. The separation is made according to the value of $K/(d_p-d_L)$.

If K is much smaller than $K_L$ then $K-K_L=-K_L$ (approximately). In this case the particle acts as though it is diamagnetic having a susceptibility $-K_L$. Separation requires reversal of direction of the magnetic force and occurs when $$K_L\ v(H\frac{\partial H}{\partial M})\ \text{max.}$$

exceeds $(d_p-d_L)$ vg s in $\theta$. Separation in this instance is made according to the value of $K_L/(d_p-d_L)$. However, since $d_L$ and $K_L$ are both constants, the separation is made solely on the basis of the particle density $d_p$. In a case where neither K nor $K_L$ may be neglected the separation is made according to the value of $(K-K_L)/(d_p-d_L)$.

If the liquid is moving the analysis will be somewhat different but the separation will be in accordance with the same particle properties. When a liquid is used, whether moving or stationary, the flow channel preferably is fully enclosed rather than open as shown in FIGS. 9*a* and 10*a*. Additional apparatus and methods which may be used to feed a moving liquid carrier through a magnetic field are disclosed in two co-pending commonly-owned applications: Ser. No. 665,265 filed Mar. 9, 1976 by Jack Sun and Dartrey Lewis for METHOD AND APPARATUS FOR MAGNETIC SEPARATION OF PARTICLES IN A FLUID CARRIER and now U.S. Pat. No. 4,102,780 and Ser. No. 665,266 filed Mar. 9, 1976 by Jack Sun for ELUTRIATOR, and now abandoned.

In the description of methods and apparatus for separating particles in accordance with the magnetic susceptibilities of the particles the word "particles" should be understood to include pieces of the material of any size and the words "magnetic susceptibilities" should be interpreted in the following manner.

Since magnetic separation of particles is based upon opposing a magnetic force to a non-magnetic force, which non-magnetic force may be gravitational, centrifugal, fluid viscous force, frictional force and the like, the separation depends not only upon the force exerted on the particles by the magnetic field but also upon the non-magnetic force which is determined by other physical properties of the particle. For example, when the opposing force is gravitational in a low density medium such as air, the separation is in accordance with the particle susceptibility K divided by its density $d_p$ or $K/d_p$. When the particle is immersed in a liquid the separation is in accordance with $K/(d_p-d_L)$, the $d_L$ is the density of the liquid. When the particle is immersed in a magnetic liquid, the separation is in accordance with $(K_p-K_L)/(d_p-d_L)$, where $K_p$ and $K_L$ are the susceptibilities of the particle and the liquid. In the case where $K_L$ is much larger than $K_p$, so that $K_p$ may be neglected and $K_L$ and $d_L$ are constants, separation is in accordance with the density of the particle $d_p$ and $K_p$ is not involved.

In cases of other external forces opposing the magnetic force $(K_p-K_L)$ vH $(\partial H/\partial X)$ similar analyses are required to determine the nature of the separation.

The apparatus shown in FIGS. 11, 12*a* and 12*b* is arranged for the separation of particles according to their diamagnetic susceptibilities. The particle flow is from left to right into a barrier having a katadynamic field on the lefthand side and an anadynamic field on the righthand side as shown in FIG. 3*c*. If the pole pieces producing the field are rearranged so as to produce an anadynamic field on the lefthand side and a katadynamic field on the righthand side, the apparatus of FIGS. 11, 12*a* and 12*b* may be used for separating particles according to their paramagnetic properties.

EXAMPLE 1

A sample containing paramagnetic particles was prepared from a larger sample of river delta mud having a minimum particle size of 106 microns. The larger sample was first passed in conventional fashion through a Model L1, Frantz ISODYNAMIC magnetic separator with the chute arranged to have a transverse slope to the left at an angle $\theta$ of 15° and a forward slope at an angle $\theta$ of 25°. With a field strength of 18,500 gauss in the gap between the pole pieces, a non-magnetic fraction of 18.75 grams was obtained. The 18.75 gram sample was determined by microscopic inspection to include many predominately black particles, which were known to be very weakly paramagnetic, and many light grey particles.

A magnetic barrier was established in accordance with the invention by using the outside or non-isodynamic portion of the Model L1 pole pieces. This portion of the pole pieces has the form of a quarter circle of ⅜ths inch radius which merges at its end into tangential plane surfaces in the manner illustrated in FIG. 2*b*. The gap between the pole pieces, corresponding to 2*d* in FIG. 2*b*, was 5/32nds of an inch over the upper half (12.7 cm) of the pole pieces and gradually increased from the 5/32nd inch value over the lower half of the pole pieces. The barrier generated had the configuration shown in FIG. 8*a* and had a maximum strength ($H\partial H/\partial X$) of $38.525\times10^6$ Oe.$^2$/cm over the upper half of the L1 pole pieces, corresponding to region $O-y_2$ in FIG. 8*a*. The flow channel structure and orientation employed was similar to that depicted in FIG. 9*a*. The sample was fed to the upper righthand end of the flow channel on the upstream side of the barrier.

Five successive separations were performed, using the full 18.75 gram sample in the first run and only the non-magnetic fraction from the preceding run for each successive run. The following results were obtained:

TABLE I

| Side Slope ($\theta$°) | Forward Slope ($\phi$°) | Gap Field Strength (gauss) | Magnetic Fraction (g) | Non-Magnetic Fraction (g) | Total (g) |
|---|---|---|---|---|---|
| 15 | 25 | 13,800 | 2.7 | 16.05 | 18.75 |
| 15 | 25 | 18,500 | 4.1 | 11.95 | 16.05 |
| 15 | 25 | 19,500 | .6 | 11.35 | 11.95 |
| 6 | 25 | 19,500 | 3.2 | 8.25 | 11.35 |
| 4 | 25 | 19,500 | 1.6 | 6.55 | 8.25 |

Each separation was repeated and found to be closely reproducible. The final non-magnetic fraction (6.55 grams) was very light grey in color and found to contain almost no predominantly black particles when examined by microscope.

EXAMPLE 2

A C-shaped core for a magnetic circuit of the type illustrated in FIG. 1 was constructed by cutting a ⅛th inch gap in one leg of a square loop of steel having a 1.27 cm×1.27 cm cross section. The inner portions of the core surfaces bordering the gap were cut away so as to form opposing pole faces which tapered outwardly to a sharp edge at the outer surface of the core. The gap between the sharp edges of the pole faces was approximately ⅛th inch. The core was wound with a 1000 turn winding, which winding was connected to a half wave rectified a.c. current. This current can be viewed as equivalent to an average d.c. current with a superimposed a.c. current. A single a.c. ammeter was used to measure the current supplied to the coil. The magnetic circuit was arranged with the plane of symmetry of the pole faces in the horizontal plane. A mixture composed of beach sand particles and copper disks was placed on a flat plastic sheet. The plastic sheet was then introduced by hand between the pole faces generally in the plane symmetry of the faces and moving from the outside of the core toward the inside of the core in a direction perpendicular to the lengthwise extent of the pole faces. With a current of 1.25 amperes applied to the winding, the copper disks were blocked by the barrier established between the sharp opposing edges of the pole faces, whereas the sand particles moved with the plastic sheet through the barrier.

EXAMPLE 3

A mixture of silicon carbide particles and natural diamond particles ranging in size from 90 microns to 75 microns was separated using the Model L1 Frantz ISODYNAMIC magnetic separator, having the same pole face configuration, size, and separation as described in Example 1, with the flow channel and pole pieces oriented in the manner shown in FIG. 10*a*. The flow channel had a transverse slope to the right at an angle of 3° and a forward slope at an angle of 15°. The current to the magnetizing coils of the separator was adjusted until a field strength of 18,500 gauss was established in the gap between the pole pieces. At that field strength, a diamagnetic fraction consisting essentially of natural diamond particles was obtained along the barrier, and a separate fraction containing substantially all of the silicon carbide particles was collected on the downstream side of the barrier, thereby indicating that the diamagnetic diamond particles had been blocked and retained by the barrier while the silicon carbide particles passed through the barrier. The diamond particles were predominately of a light grey color and the silicon carbide particles of a darker color, which readily permitted their identification by visual inspection.

With no magnetic field applied, all of the particles of the samples tested in Examples 1, 2 and 3 above passed through the locus at which the barrier had been established.

Although the invention has been described and illustrated herein with reference to specific embodiments thereof, it will be understood that the invention is not limited to such specific embodiments but is subject to variation and modification without departing from the inventive concepts embodied therein. For example, whereas all of the embodiments described herein have embodied magnetic barriers which are straight in the lengthwise direction, the pole pieces may be constructed, if desired, to provide a locus $X_B$ of maximum magnetic energy gradient which lies along any line on a simple surface. All such variations and modifications, therefore, are intended to be included within the scope of the appended claims.

I claim:

1. A method for separating a flowable mixture of particles in accordance with the magnetic susceptibilities of the particles, comprising:

establishing a nonuniform magnetic field having in a direction transverse to the direction of the field, in contiguous sequence, a katadynamic field region, an isodynamic field region, and an anadynamic field region, whereby the magnetic energy gradient $H(\partial H/\partial X)$ in said transverse direction is at a maximum at the locus of said isodynamic field region and decreases therefrom on either side thereof;

feeding a mixture of particles into the magnetic field on one side of the locus of maximum transverse gradient in a manner such that the particles are urged by non-magnetic force in said transverse direction towards the locus of maximum transverse gradient, the magnitude of the maximum transverse gradient being such that particles having a magnetic susceptibility to the field equal to or greater than a selected susceptibility at which a separation is to be effected are prevented by the transverse magnetic force acting thereon from passing from said one side of the locus of maximum transverse gradient to the other side while particles having a magnetic susceptibility to the field less than said selected susceptibility are urged across the locus of maximum transverse gradient by the non-magnetic force; and collecting the particles which do not cross said locus of maximum transverse gradient separately from the particles which cross said locus.

2. The method of claim 1 wherein:

the magnetic field is established such that in a transversely extending region thereof the magnitude of the magnetic energy gradient in the direction of the field is small relative to the magnitude of said maximum transverse gradient; and the mixture is fed into the magnetic field within said region where the magnetic energy gradient in the field direction is relatively small.

3. The method of claim 1 wherein:

the particles to be prevented from crossing from said one side of the locus of maximum transverse gradient to the other side are paramagnetic; and said one side of the locus of maximum transverse gradient on which the mixture is fed is the side on which said anadynamic field is established.

4. The method of claim 1 wherein:

the particles to be prevented from crossing from said one side of the locus of maximum transverse gradient to the other side are diamagnetic; and said one side of the locus of maximum transverse gradient on which the mixture is fed is the side on which said katadynamic field is established.

5. The method of claim 1 wherein the field establishing step comprises establishing superimposed a.c. and d.c. magnetic fields, said d.c. field being effective to create said maximum transverse gradient and said a.c. field being effective to cause eddy currents in conductive particles in the mixture to induce values of magnetic susceptibility greater than said selected susceptibility, whereby the magnetized conductive particles will be deflected on said one side of the locus of maximum transverse gradient.

6. The method of claim 1 wherein the dimension of said isodynamic field region in said transverse direction is small relative to the dimension in said transverse direction of either the adjoining anadynamic field region or the adjoining katadynamic field region.

7. The method of claim 1 wherein said magnetic field is established such that said maximum transverse gradient is substantially uniform in magnitude over at least that portion of the magnetic field lying between the point of first encounter of the particles with said locus of maximum transverse gradient and the point of first interception, for separate collection, of those particles which do not cross said locus.

8. The method of claim 1 further comprising:

establishing a plurality of magnetic field regions in side-by-side relation, each of said field regions having a locus at which the transverse magnetic energy gradient $H(\partial H/\partial X)$ thereof is at a maximum, the magnitude of each said maximum transverse gradient being different, thereby to provide a succession of maximum gradients;

feeding the mixture through said succession of maximum gradients; and separately collecting the particles deflected by each maximum gradient.

9. The method of claim 8 wherein the magnitude of the maximum transverse gradient progressively increases from field to field in said succession, thereby to provide for the deflection by succeeding maximum transverse gradients of particles of progressively lower magnetic susceptibility.

10. The method of claim 1 wherein the mixture feeding step includes dispersing the mixture in a fluid and feeding the fluid-mixture dispersion into the magnetic field, whereby the particles are separated along the locus of maximum transverse gradient substantially in accordance with the relative value of $(K_p-K_F)/(d_p-d_F)$ where $K_p$ is the magnetic susceptibility of the particles, $K_F$ is the magnetic susceptibility of the fluid, and $d_p$ is the density of the particles, and $d_F$ is the density of the fluid.

11. The method of claim 10 wherein the magnetic susceptibility of the fluid is very much greater than that of any particle contained in the mixture, whereby the particles are separated substantially in accordance with the relative values of $d_p$.

12. The method of claim 1 wherein the mixture is fed into the magnetic field in a manner such that the particles are urged by said nonmagnetic force both towards and lengthwise of the locus of maximum transverse gradient, whereby particles deflected on said one side of said locus move therealong lengthwise of said locus.

13. The method of claim 12 further comprising varying the magnitude of the maximum transverse gradient over at least a portion of the length of said locus.

14. The method of claim 13 wherein the magnitude of the maximum transverse gradient is at a maximum value and substantially uniform over an upstream lengthwise region of said locus and decreases from said maximum value downstream thereof, whereby the particles deflected by the maximum transverse gradient move lengthwise of said upstream region on said one side of the locus of maximum transverse gradient and are released to cross said locus according to their magnetic susceptibilities after moving downstream of said region.

15. The method of claim 13 wherein:

said variation in the magnitude of the maximum transverse gradient along said locus is progressive from an upstream point of maximum magnitude to a downstream point of minimum magnitude; and the mixture is fed into the magnetic field adjacent said point of maximum magnitude, whereby the particles progressively cross the locus of maximum transverse gradient according to their magnetic susceptibilities in the course of downstream movement along said locus.

16. The method of claim 15 wherein the particles which cross the locus of maximum transverse gradient in the course of downstream movement therealong are collected into a plurality of fractions of different magnetic susceptibilities.

17. Apparatus for separating a flowable mixture of particles in accordance with the magnetic susceptibilities of the particles, comprising:

means for establishing a nonuniform magnetic field comprising, in a direction transverse to the direction of the field and in contiguous sequence, a series of field regions, said series consisting of a katadynamic field region, an isodynamic field region, and an anadynamic field region, the dimension of said isodynamic field region in said transverse direction being small relative to the dimension in said transverse direction of either the adjoining anadynamic field region or the adjoining katadynamic field region in said series, the magnetic energy gradient $H(\partial H/\partial X)$ of said magnetic field in said transverse direction being at a maximum at the locus of said isodynamic field region;

means for feeding a mixture of particles into the magnetic field on one side of the locus of said maximum transverse gradient in such a manner that the particles are urged by nonmagnetic force in said transverse direction towards said locus of maximum transverse gradient;

said field establishing means and said mixture feeding means being adjustable such that the magnitude of the transversely-acting magnetic force exerted by said maximum transverse gradient, in the direction opposite to the transverse direction of movement of the particles towards said locus, on those particles having a magnetic susceptibility equal to or greater than a selected susceptibility at which a separation is to be effected is greater than the transversely-acting nonmagnetic force urging said particles towards said locus, whereby said particles of equal or greater susceptibility are prevented by the magnetic force acting thereon from passing from said one side of the locus of maximum transverse gradient to the other side while particles having a magnetic susceptibility less than said selected susceptibility are urged across the locus of maximum transverse gradient by the transversely-acting nonmagnetic force, said one side of said locus on which said particles are fed by said feeding means being the anadynamic field region side where the particles to be prevented from crossing said locus are paramagnetic and the katadynamic side where the particles to be prevented from crossing said locus are diamagnetic;

means for collecting the particles prevented from passing from said one side of the locus of maximum transverse gradient to the other side separately from the particles which cross said locus; said field establishing means establishing said magnetic field such that the magnitude of said maximum transverse gradient is substantially uniform over at least that portion of the magnetic field extending between the point of first encounter of said particles with said locus and the point of first interception by said collecting means of those particles prevented from crossing said locus; and the mixture feeding means includes nonmagnetic means defining a flow path for the particles over at least said portion of the magnetic field.

18. The apparatus of claim 17 in which said transversely-acting nonmagnetic force is a component of a nonmagnetic force acting in a direction oblique to said transverse direction.

19. The apparatus of claim 17 wherein:

the field establishing means includes a pair of spaced-apart pole pieces, the opposing faces of said pole pieces being substantially symmetrical in cross section in said transverse direction; and the flow path defining means guides the particles generally along the plane of symmetry of said opposing faces over at least said portion of the magnetic field.

20. The apparatus of claim 17 wherein the field establishing means includes means for establishing superimposed d.c. and a.c. magnetic fields, said d.c. field being effective to create said maximum transverse gradient and said a.c. magnetic field being effective to cause eddy currents in conductive particles in the mixture to induce values of magnetic susceptibility greater than said selected susceptibility, whereby the induced conductive particles are prevented by magnetic force from passing from said one side of the locus of maximum transverse gradient to the other side.

21. The apparatus of claim 17 wherein the field establishing means includes means for varying the magnitude of the maximum transverse gradient over at least a portion of the length of said locus other than said portion of uniform transverse cross section.

22. The apparatus of claim 17 wherein:

the field establishing means includes means for defining within the magnetic field a transversely extending region in which the magnitude of the magnetic energy gradient in the direction of the field is small relative to the magnitude of said maximum transverse gradient; and the flow path defining means guides the particles generally within said region where the magnetic energy gradient in the field direction is relatively small over at least said portion of the magnetic field.

23. Apparatus for separating a flowable mixture of particles in accordance with the magnetic susceptibilities of the particles, comprising:

means, including a pair of spaced-apart elongate pole pieces having opposing pole faces, for establishing a non-uniform magnetic field, said opposing pole faces being shaped in cross section transversely of the elongate direction of the pole pieces such that said magnetic field comprises in said transverse direction and in contiguous sequence, a series of field regions, said series consisting of a katadynamic field region, an isodynamic field region, and an anadynamic field region, the dimension of said isodynamic field region in said transverse direction being small relative to the dimension in said transverse direction of either the adjoining anadynamic field region or the adjoining katadynamic field region in said series, the magnetic energy gradient $H(\partial H/\partial X)$ of the field in said transverse direction being at a maximum at the locus of said isodynamic field region;

means for feeding a mixture of particles between the pole pieces on one side of the locus of said maximum transverse gradient in a manner such that the particles are urged by nonmagnetic force towards and lengthwise of the locus of maximum transverse gradient;

said field establishing means and said mixture feeding means being adjustable such that those particles having a magnetic susceptibility equal to or greater than a selected susceptibility at which a separation is to be effected are retained on said one side of the locus of maximum transverse gradient by the transversely-acting magnetic force exerted thereon by said maximum transverse gradient, in the direction opposite to the transverse direction of movement of the particles towards such locus, and are urged lengthwise along said one side of such locus by a lengthwise-acting component of said nonmagnetic force, while particles having a magnetic susceptibility less than said selected susceptibility are urged across the locus of maximum transverse gradient by a transversely-acting component of the nonmagnetic force, said one side of said locus on which said particles are fed by said feeding means being the anadynamic field region side where the particles to be retained on said one side of said locus are paramagnetic and the katadynamic side where the particles to be retained on said one side are diamagnetic;

means for collecting the particles retained on said one side of the locus of maximum transverse gradient separately from the particles which cross said locus, said pole pieces being of uniform transverse cross section and spaced apart by uniform distance over at least a first portion thereof extending between the point of first encounter of said particles with said locus and the point of first interception by said collecting means of those particles retained on said one side of said locus, whereby the magnitude of said maximum transverse gradient is also uniform over said portion of the pole pieces; and the mixture feeding means includes nonmagnetic means defining a flow path for the particles extending between said pole pieces over at least said first portion thereof.

24. The apparatus of claim 23 wherein:

the opposing faces of said pole pieces are substantially symmetrical in said transverse cross section; and the flow path defining means guides the particles generally along the plane of symmetry of said opposing faces over at least said first portion thereof.

25. The apparatus of claim 23 wherein the mixture feeding includes means for varying the angle of approach at which the particles are urged by said nonmagnetic force towards the locus of maximum transverse gradient.

26. The apparatus of claim 23 wherein the spacing between the opposing pole faces varies over at least a second portion of the length of the pole pieces other than said first portion to provide a maximum transverse gradient which varies in magnitude over at least said second portion of the length of the pole pieces.

27. The apparatus of claim 23 wherein the field establishing means includes means for varying the field strength and the maximum transverse gradient established between the pole pieces.

28. The apparatus of claim 23 wherein the field establishing means includes means for establishing superimposed d.c. and a.c. magnetic fields, said d.c. magnetic field being effective to create said maximum transverse gradient and said a.c. magnetic field being effective to cause eddy currents in conductive particles in the mixture to induce values of magnetic susceptibility greater than said selected susceptibility, whereby the magnetized conductive particles are deflected by magnetic force on said one side of the locus of maximum transverse gradient.

29. The apparatus of claim 23 wherein the flow path defining means comprises a coating of corrosion resistant material on each of said pole faces over at least said first portion thereof of a thickness to confine the flow of the mixture to within the vicinity of the plane of symmetry of said pole faces.

30. The apparatus of claim 23 wherein the opposing pole faces are shaped to provide a maximum transverse gradient which varies in magnitude over at least a portion of the length of the pole pieces other than said portion of uniform transverse cross section.

31. The apparatus of claim 30 wherein said portion of the pole faces of uniform transverse cross section comprises an upstream region of said pole pieces, thereby to provide a substantially uniform maximum transverse gradient magnitude over said upstream region, and said pole pieces are shaped over a downstream lengthwise region to provide a maximum transverse gradient magnitude which decreases over said downstream region, whereby the particles deflected by the maximum transverse gradient move lengthwise of said upstream region on said one side of the locus of maximum transverse gradient and are released to cross said locus after moving downstream of said region, said point of first interception by said collecting means being at or upstream of the downstream end of said upstream region.

32. The apparatus of claim 23 wherein the flow path defining means includes:

an elongate flow channel;

means for supporting the flow channel between the pole pieces in general parallel alignment therewith and with the locus of maximum transverse gradient lying within the cross section of the channel; and means for introducing the mixture into an upstream region of the flow channel on said one side of the locus of maximum transverse gradient.

33. The apparatus of claim 32 wherein:

the opposing faces of said pole pieces are substantially symmetrical in said transverse cross section; and said flow channel lies generally along the plane of symmetry of said opposing faces.

34. The apparatus of claim 32 wherein the particle collecting means includes a divider located in said flow channel downstream of the particle feeding region for guiding the particles deflected on said one side of the locus of maximum transverse gradient from the flow channel separately from the particles which cross said locus, the upstream end of said divider comprising said point of first interception by said collecting means.

35. The apparatus of claim 32 wherein:

the flow channel supporting means includes means for supporting the pole pieces and the flow channel such that the flow chanel is inclined to the horizontal both in the lengthwise direction and in the transverse direction; and said one side of the locus of maximum transverse gradient is the uppermost side, whereby the mixture is urged by gravity generally towards and lengthwise of said locus.

36. Apparatus for separating a flowable mixture of particles in accordance with the magnetic susceptibilities of the particles, comprising:

means, including a pair of spaced-apart elongate pole pieces having opposing faces, for establishing a nonuniform magnetic field, said opposing pole faces being shaped in transverse cross section over at least a first lengthwise region thereof so as to produce therebetween, in contiguous transverse sequence, a katadynamic field region, an iosdynamic field region, and an anadynamic field region such that the magnetic energy gradient $H(\partial H/\partial X)$ in said transverse direction is at a maximum at the locus of said isodynamic field region and is substantially uniform over at least said first region;

an elongate flow channel located between the pole pieces in general parallel alignment therewith and with the locus of maximum transverse gradient lying within the cross section of the channel;

means for supporting the pole pieces and the flow channel such that the flow channel is inclined to the horizontal both in the lengthwise direction and in the transverse direction;

means for feeding a mixture of particles into an upstream region of the flow channel such that said particles enter said first lengthwise region of the pole pieces on the uppermost side of the locus of maximum transverse gradient, whereby the particles are urged by gravity towards and lengthwise of said locus;

said field establishing means and said supporting means being arranged such that those particles having a magnetic susceptibility equal to or greater than a selected susceptibility at which a separation is to be effected are retained on said uppermost side of the locus of maximum transverse gradient by the transversely-acting magnetic force exerted thereon by said maximum transverse gradient and are urged lengthwise along said uppermost side of such locus by a lengthwise-acting gravitational component, while particles having a magnetic susceptibility less than said selected susceptibility are urged across the locus of maximum transverse gradient by a transversely-acting gravitational component; and means for collecting the particles retained on said uppermost side of the locus of maximum transverse gradient separately from the particles which cross said locus, said collecting means including means for intercepting those particles retained on said uppermost side before said particles move downstream of said first lengthwise region of said pole pieces.

37. The apparatus of claim 36 wherein:

the opposing faces of said pole pieces are substantially symmetrical in cross section; and said supporting means support said flow channel generally in the plane of symmetry of said opposing faces.

38. The apparatus of claim 36 wherein the pole faces are shaped over a second, downstream lengthwise region to provide a maximum transverse gradient magnitude which decreases over said downstream region, whereby the particles retained on said uppermost side by the maximum transverse gradient move lengthwise of said first region on said uppermost side of the locus of maximum transverse gradient and are released to cross said locus after moving downstream of said region.

39. The apparatus of claim 36 further comprising:

a plurality of said pairs of elongate pole pieces arranged in side-by-side relation;

means for establishing said magnetic field between each pair of pole pieces, thereby to establish a locus transversely of each pair of pole pieces at which the local transverse magnetic energy gradient $H(\partial H/\partial X)$ is a maximum, the magnitude of each local maximum transverse gradient being different; and wherein said elongate flow channel extends between the pole pieces of all of said pole-piece pairs in general parallel alignment with the poles thereof and with the loci of all of said local maximum transverse gradients lying within the cross section of said flow channel;

said supporting means supports all of said pole piece pairs and said flow channel such that the flow channel is inclined to the horizontal both in the lengthwise direction and in the transverse direction;

said mixture feeding means includes means for feeding the particles into an upstream region of the flow channel on the uppermost side of the uppermost of said loci of maximum transverse gradients, whereby the particles are urged by gravity through said loci of maximum transverse gradients in succession; and the particle collecting means includes means for separately collecting the particles deflected by each maximum transverse gradient.

40. The apparatus of claim 39 wherein the magnitudes of the maximum transverse gradients progressively increase from pole pair to pole pair in said succession, thereby to provide for the retention between succeeding pole pairs of particles of progressively lower magnetic susceptibility.

41. Apparatus for separating a flowable mixture of particles in accordance with the magnetic susceptibilities of the particles, comprising:

a plurality of pairs of spaced-apart elongate pole pieces having opposing pole faces, said pairs of pole pieces being arranged in side-by-side relation;

means for establishing a non-uniform magnetic field between each pair of pole pieces, said opposing pole faces of each pair of pole pieces being shaped in cross section transversely of the elongate direction of the pole pieces such that said each magnetic field comprises in said transverse direction and in contiguous sequence, a series of field regions, said series consisting of a katadynamic field region, an isodynamic field region, and an anadynamic field region, the dimension of said isodynamic field region in said transverse direction being small relative to the dimension in said transverse direction of either the adjoining anadynamic field region or the adjoining katadynamic field region in said series, the magnetic energy gradient $H(\partial H/\partial X)$ of the field in said transverse direction being at a maximum at the locus of said isodynamic field region;

means for feeding a mixture of particles between the pole pieces of said pairs of side-by-side pole pieces in succession and so that they enter each magnetic field on one side of the locus of said maximum transverse gradient in a manner that the particles are urged by nonmagnetic force towards and lengthwise of the locus of maximum transverse gradient, thereby to pass the particles through a succession of maximum transverse magnetic energy gradients;

said field establishing means and said mixture feeding means being adjustable so that those particles having a magnetic susceptibility equal to or greater than a selected susceptibility at which a separation is to be effected are retained on said one side of the locus of maximum transverse gradient by the transversely-acting magnetic force exerted thereon by said maximum transverse gradient, in the direction opposite to the transverse direction of movement of the particles towards such locus, and are urged lengthwise along said one side of such locus by a lengthwise-acting component of said nonmagnetic force, while particles having a magnetic susceptibility less than said selected susceptibility are urged across the locus of maximum transverse gradient by a transversely-acting component of the nonmagnetic force, said one side of said locus on which said particles are fed by said feeding means being the anadynamic field region side where the particles to be retained on said one side of said locus are paramagnetic and the katadynamic side where the particles to be retained on said one side are diamagnetic; and means for collecting the particles retained on said one side of each locus of maximum transverse gradient separately from the particles which cross said locus, said pole pieces being of uniform transverse cross section and spaced apart by a uniform distance over at least a first portion thereof extending between the point of first encounter of said particles with said locus and the point of first interception by said collecting means of those particles retained on said one side of said locus, whereby the magnitude of said maximum transverse gradient is also uniform over said portion of the pole pieces.

42. The apparatus of claim 41 wherein the means for establishing said magnetic field between each pair of pole pieces includes means for progressively increasing the magnitude of the local maximum transverse gradient from pole pair to pole pair in said succession, thereby to provide for the retention between succeeding pole pairs of particles of progressively lower magnetic susceptibility.

* * * * *

UNITED STATES PATENT OFFICE

CERTIFICATE OF CORRECTION

Patent No. 4,235,710 Dated November 25, 1980

Inventor(s) Jack J. Sun

It is certified that error appears in the above-identified patent and that said Letters Patent are hereby corrected as shown below:

Column 2, line 3, after "of" insert -- the --;

Column 6, line 49, "for" should read -- For --;

Column 7, line 37, "balances the downwardly acting gravitational force FG" should appear in the same size type as the other text in column 7, and "FG" should read -- $F_G$ --;

Column 8, line 21, "10a 10b" should read -- 10a and 10b --;

Column 14, line 5, "∂M" should read -- ∂X --;

Column 15, line 23, "end" should read -- ends --;

Column 15, line 48, "8.25" should read -- 8.15 --; and

Column 15, line 49, "8.25" should read -- 8.15 --.

Signed and Sealed this

*Thirty-first* Day of *March 1981*

[SEAL]

*Attest:*

RENE D. TEGTMEYER

*Attesting Officer*

*Acting Commissioner of Patents and Trademarks*